US011260668B2

(12) United States Patent
Govyadinov et al.

(10) Patent No.: US 11,260,668 B2
(45) Date of Patent: Mar. 1, 2022

(54) FLUID EJECTION DEVICE INCLUDING RECIRCULATION SYSTEM

(71) Applicant: Hewlett-Packard Development Company, L.P., Spring, TX (US)

(72) Inventors: Alexander Govyadinov, Corvallis, OR (US); Erik D Torniainen, Corvallis, OR (US); David P Markel, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/065,831

(22) Filed: Oct. 8, 2020

(65) Prior Publication Data

US 2021/0023852 A1 Jan. 28, 2021

Related U.S. Application Data

(63) Continuation of application No. 16/217,008, filed on Dec. 11, 2018, now Pat. No. 10,807,376, which is a
(Continued)

(51) Int. Cl.
*B41J 2/18* (2006.01)
*B41J 2/14* (2006.01)
(Continued)

(52) U.S. Cl.
CPC ..... *B41J 2/18* (2013.01); *B01L 3/50273* (2013.01); *B01L 3/502715* (2013.01);
(Continued)

(58) Field of Classification Search
CPC ..... B41J 2/18; B41J 2/14201; B41J 2/1404; B41J 2/1753; B41J 2002/14467;
(Continued)

(56) References Cited

U.S. PATENT DOCUMENTS 3,552,207 A 1/1971 Monk et al.
3,856,467 A 12/1974 Picker
(Continued)

FOREIGN PATENT DOCUMENTS

CA 2444525 4/2004
CN 1498761 5/2004
(Continued)

OTHER PUBLICATIONS

A Stepper Micropump for Ferrofluid Driven Microfluidic Systems; http://www.bentham.org/mns/samples/mns%201-1/0004MNS.pdf> Publication Date: 2009; On pp. 17-21; Nam-Trung Nguyen et al.
(Continued)

*Primary Examiner* — Lamson D Nguyen
(74) *Attorney, Agent, or Firm* — HP Inc. Patent Department

(57) ABSTRACT

A fluid ejection device may include a first channel having a first end and a second end, a first drop ejector along the first channel, a second channel having a first end and a second end, a second drop ejector along the second channel, a third channel extending between and connecting the first end of the first channel and the first end of the second channel, a fourth channel extending between and connecting the second end of the firs channel and the second end of the second channel and a fifth channel extending between and connecting the third channel and the fourth channel.

20 Claims, 7 Drawing Sheets

Related U.S. Application Data continuation of application No. 15/432,400, filed on Feb. 14, 2017, now Pat. No. 10,173,435, which is a continuation of application No. 14/737,050, filed on Jun. 11, 2015, now Pat. No. 9,604,212, which is a continuation of application No. 13/643,646, filed as application No. PCT/US2010/035697 on May 21, 2010, now Pat. No. 9,090,084.

(51) Int. Cl.

| | |
|---|---|
| ***B41J 2/175*** | (2006.01) |
| ***F04B 19/00*** | (2006.01) |
| ***F04B 19/20*** | (2006.01) |
| ***F04B 19/24*** | (2006.01) |
| ***B01L 3/00*** | (2006.01) |

(52) U.S. Cl.

CPC ..... *B01L 3/502746* (2013.01); *B41J 2/1404* (2013.01); *B41J 2/14201* (2013.01); *B41J 2/1753* (2013.01); *F04B 19/006* (2013.01); *F04B 19/20* (2013.01); *F04B 19/24* (2013.01); *B01L 2300/088* (2013.01); *B01L 2300/0816* (2013.01); *B01L 2300/123* (2013.01); *B01L 2400/0481* (2013.01); *B01L 2400/082* (2013.01); *B41J 2002/14467* (2013.01); *B41J 2202/12* (2013.01)

(58) Field of Classification Search

CPC ..... B41J 2202/12; F04B 19/006; F04B 19/20; F04B 19/24; B01L 3/502715; B01L 3/50273; B01L 3/502746; B01L 2300/0816; B01L 2300/088; B01L 2300/123; B01L 2400/0481; B01L 2400/082

See application file for complete search history.

(56) References Cited

U.S. PATENT DOCUMENTS

| | | | |
|---|---|---|---|
| 4,318,114 | A | 3/1982 | Huliba |
| 5,412,411 | A | 5/1995 | Anderson |
| 5,764,258 | A | 6/1998 | Hetzer et al. |
| 5,807,749 | A | 9/1998 | Hornemann |
| 5,818,485 | A | 10/1998 | Rezanka |
| 5,820,260 | A | 10/1998 | Vander Heyden et al. |
| 6,010,316 | A | 1/2000 | Haller et al. |
| 6,017,117 | A | 1/2000 | McClelland et al. |
| 6,055,002 | A | 4/2000 | Wen et al. |
| 6,079,873 | A | 6/2000 | Cavicchi et al. |
| 6,106,091 | A | 8/2000 | Osawa et al. |
| 6,152,559 | A | 11/2000 | Kojima |
| 6,193,413 | B1 | 2/2001 | Lieberman |
| 6,227,660 | B1 | 5/2001 | McClelland et al. |
| 6,227,824 | B1 | 5/2001 | Stehr |
| 6,244,694 | B1 | 6/2001 | Weber et al. |
| 6,283,718 | B1 | 9/2001 | Prosperetti et al. |
| 6,351,879 | B1 | 3/2002 | Furlani et al. |
| 6,360,775 | B1 | 3/2002 | Barth et al. |
| 6,431,694 | B1 | 8/2002 | Ross |
| 6,450,773 | B1 | 9/2002 | Upton |
| 6,467,887 | B2 | 10/2002 | Lopez et al. |
| 6,481,984 | B1 | 11/2002 | Shinohara et al. |
| 6,568,799 | B1 | 5/2003 | Yang et al. |
| 6,631,983 | B2 | 10/2003 | Romano, Jr. et al. |
| 6,645,432 | B1 | 11/2003 | Anderson et al. |
| 6,655,924 | B2 | 12/2003 | Ma |
| 6,730,206 | B2 | 5/2004 | Ricco et al. |
| 6,752,493 | B2 | 6/2004 | Dowell et al. |
| 6,910,797 | B2 | 6/2005 | Falcon |
| 6,953,236 | B2 | 10/2005 | Silverbrook |
| 7,025,323 | B2 | 4/2006 | Krulevitch et al. |
| 7,040,745 | B2 | 5/2006 | Kent |
| 7,049,558 | B2 | 5/2006 | Baer et al. |
| 7,094,040 | B2 | 8/2006 | Higashino et al. |
| 7,097,287 | B2 | 8/2006 | Nakao et al. |
| 7,118,189 | B2 | 10/2006 | Kuester et al. |
| 7,182,442 | B2 | 2/2007 | Sheinman |
| 7,204,585 | B2 | 4/2007 | Bruinsma et al. |
| 7,217,395 | B2 | 5/2007 | Sander |
| 7,291,512 | B2 | 11/2007 | Unger |
| 7,427,274 | B2 | 9/2008 | Harris et al. |
| 7,470,004 | B2 | 12/2008 | Eguchi et al. |
| 7,543,923 | B2 | 6/2009 | McNestry |
| 7,647,860 | B2 | 1/2010 | Cresswell et al. |
| 7,727,478 | B2 | 6/2010 | Higashino et al. |
| 7,762,719 | B2 | 7/2010 | Fon et al. |
| 7,763,453 | B2 | 7/2010 | Clemmens et al. |
| 7,784,495 | B2 | 8/2010 | Prakash et al. |
| 7,832,429 | B2 | 11/2010 | Young et al. |
| 7,871,160 | B2 | 1/2011 | Kang et al. |
| 8,286,656 | B2 | 10/2012 | Rastegar et al. |
| 8,329,118 | B2 | 12/2012 | Padmanabhan et al. |
| 8,439,481 | B2 | 5/2013 | Xie et al. |
| 2001/0030130 | A1 | 10/2001 | Ricco et al. |
| 2002/0009374 | A1 | 1/2002 | Higashino |
| 2002/0079008 | A1 | 6/2002 | Chien et al. |
| 2002/0098122 | A1 | 7/2002 | Singh et al. |
| 2002/0156383 | A1 | 10/2002 | Altman et al. |
| 2002/0197167 | A1 | 12/2002 | Kornelsen |
| 2003/0215342 | A1 | 11/2003 | Higashino et al. |
| 2004/0024002 | A1 | 2/2004 | Burnett et al. |
| 2004/0063217 | A1 | 4/2004 | Webster et al. |
| 2004/0180377 | A1 | 9/2004 | Manger et al. |
| 2004/0200724 | A1 | 10/2004 | Fujii et al. |
| 2004/0202548 | A1 | 10/2004 | Dai et al. |
| 2004/0224002 | A1 | 11/2004 | Fishman et al. |
| 2005/0052513 | A1 | 3/2005 | Inoue |
| 2005/0069425 | A1 | 3/2005 | Gray et al. |
| 2005/0092662 | A1 | 5/2005 | Gilbert et al. |
| 2005/0129529 | A1 | 6/2005 | Cho |
| 2005/0196304 | A1 | 9/2005 | Richter et al. |
| 2005/0220630 | A1 | 10/2005 | Bohm |
| 2005/0249607 | A1 | 11/2005 | Klee |
| 2005/0282054 | A1 | 12/2005 | Ishida et al. |
| 2006/0046300 | A1 | 3/2006 | Padmanabhan et al. |
| 2006/0051218 | A1 | 3/2006 | Harttig |
| 2006/0123892 | A1 | 6/2006 | Brekelmans et al. |
| 2007/0026421 | A1 | 2/2007 | Sundberg et al. |
| 2007/0286254 | A1 | 12/2007 | Fon et al. |
| 2007/0291082 | A1 | 12/2007 | Baumer et al. |
| 2008/0007604 | A1 | 1/2008 | Kang et al. |
| 2008/0047836 | A1 | 2/2008 | Strand et al. |
| 2008/0050283 | A1 | 2/2008 | Chou et al. |
| 2008/0055378 | A1 | 3/2008 | Drury et al. |
| 2008/0079791 | A1 | 4/2008 | Kang et al. |
| 2008/0087584 | A1 | 4/2008 | Johnson et al. |
| 2008/0118790 | A1 | 5/2008 | Kim et al. |
| 2008/0138247 | A1 | 6/2008 | Inganas et al. |
| 2008/0143793 | A1 | 6/2008 | Okuda |
| 2008/0260582 | A1 | 10/2008 | Gauer et al. |
| 2009/0007969 | A1 | 1/2009 | Gundel |
| 2009/0014360 | A1 | 1/2009 | Toner et al. |
| 2009/0027429 | A1 | 1/2009 | Jung |
| 2009/0027458 | A1 | 1/2009 | Leighton et al. |
| 2009/0038938 | A1 | 2/2009 | Mezic et al. |
| 2009/0040257 | A1 | 2/2009 | Bergstedt et al. |
| 2009/0052494 | A1 | 2/2009 | Wijffels |
| 2009/0079789 | A1 | 3/2009 | Silverbrook |
| 2009/0128922 | A1 | 5/2009 | Justis et al. |
| 2009/0147822 | A1 | 6/2009 | Tokhtuev et al. |
| 2009/0148933 | A1 | 6/2009 | Battrell et al. |
| 2009/0246086 | A1 | 10/2009 | Barbier et al. |
| 2009/0270834 | A1 | 10/2009 | Nisato et al. |
| 2009/0297372 | A1 | 12/2009 | Amirouche et al. |
| 2010/0013887 | A1 | 1/2010 | Suh |
| 2010/0024572 | A1 | 2/2010 | Roukes et al. |
| 2010/0101764 | A1 | 4/2010 | Yang |
| 2010/0173393 | A1 | 7/2010 | Handique et al. |
| 2010/0212762 | A1 | 8/2010 | Toonder et al. |
| 2010/0328403 | A1 | 12/2010 | Xie et al. |
| 2011/0240752 | A1 | 10/2011 | Meacham et al. |

(56) References Cited

U.S. PATENT DOCUMENTS

| | | | | |
|---|---|---|---|---|
| 2011/0286493 | A1 | 11/2011 | Torniainen et al. | |
| 2012/0015376 | A1 | 1/2012 | Bornhop | |
| 2012/0098907 | A1 | 4/2012 | Xie et al. | |
| 2012/0244604 | A1 | 9/2012 | Kornilovich et al. | |
| 2013/0061962 | A1 | 3/2013 | Kornilovich et al. | |
| 2013/0083136 | A1 | 4/2013 | Govyadinov et al. | |
| 2015/0091989 | A1 | 4/2015 | Govyadinov et al. | |
| 2017/0239946 | A1 | 8/2017 | Nakagawa | |
| 2018/0257384 | A1 | 9/2018 | Hara | |
| 2019/0210361 | A1* | 7/2019 | Martin | B41J 2/04541 |
| 2020/0282738 | A1* | 9/2020 | Chen | B41J 2/14145 |

FOREIGN PATENT DOCUMENTS

| | | | |
|---|---|---|---|
| CN | 1678460 | | 10/2005 |
| CN | 101100137 | | 1/2008 |
| CN | 101267885 | | 9/2008 |
| CN | 101287606 | | 10/2008 |
| CN | 101306792 | | 11/2008 |
| CN | 1673528 | | 2/2009 |
| CN | 101391530 | | 3/2009 |
| EP | 0317171 | A2 | 5/1989 |
| EP | 0568902 | A2 | 11/1993 |
| EP | 1052099 | | 11/2000 |
| EP | 1518683 | | 3/2005 |
| EP | 2018969 | | 1/2009 |
| JP | 0526170 | | 2/1993 |
| JP | 10175307 | | 6/1998 |
| JP | 2001205810 | | 7/2001 |
| JP | 2001-322099 | | 11/2001 |
| JP | 2003-527616 | | 9/2003 |
| JP | 2003528276 | | 9/2003 |
| JP | 2003-286940 | | 10/2003 |
| JP | 2003-534538 | | 11/2003 |
| JP | 2004-513342 | | 4/2004 |
| JP | 2004-169706 | A | 6/2004 |
| JP | 2004-190614 | A | 7/2004 |
| JP | 2004249741 | | 9/2004 |
| JP | 2005125668 | | 5/2005 |
| JP | 2006510854 | | 3/2006 |
| JP | 2006512545 | | 4/2006 |
| JP | 2006156894 | | 6/2006 |
| JP | 2006272614 | | 10/2006 |
| JP | 2007224844 | | 9/2007 |
| JP | 2008162270 | | 7/2008 |
| JP | 2009117344 | | 5/2009 |
| JP | 2009190370 | | 8/2009 |
| KR | 20030059797 | | 7/2003 |
| KR | 10-2005-0023512 | A | 3/2005 |
| KR | 20080004095 | | 1/2008 |
| KR | 20090082563 | | 7/2009 |
| KR | 20090108371 | | 10/2009 |
| WO | WO-0171226 | | 9/2001 |
| WO | WO-2008091294 | | 7/2008 |
| WO | 2010/044775 | A1 | 4/2010 |

OTHER PUBLICATIONS

Cindy Hany et al; Thermal Analysis Of Chemical Reaction With A Continuous Microfluidic Calorimeter; Chemical Engineering Journal 160 (2010); Jul. 10, 2009; pp. 814-822.

Daniel C. Leslie, et. al.; Frequency-specific Flow Control in Microfluidic Circuits with Passive Elastomeric Features; Nature Physics; Feb. 1, 2009; pp. 231-235.

Fadl et al; "The effect of the Microfluidic Diodicity on the Efficiency of Valve-Less Rectification Micropumps Using Lattice Boltzmann Method"; Microsyst Technol; Jul. 2009.

Inkjet Photo Printers, Ink, Paper, and Laser Toner Too!; InkJet Printers Paper Reviews; inkjethelper.com.

Koltay et al; "Non-Contact Liquid Handling: Basics and Technologies"; http://www.labautopedia.com/mw/index.php/Non-Contact Liquid Handling: Basics and Technologies.

Leslie Y. Yeo et al, Fast Inertial Microfluidic Actuation and Manipulation Using Surface Acoustic Waves; FEDSM-ICNMM2010 Meeting; Aug. 1-5, 2010, pp. 1-8.

Micropumps, Microvalves, and Micromixers Within Per Microfluidic Chips: Advances and Trends; http://laser.scnu.edu.cn/xingdaPDF/Zhang%20Chunsun%20Biotech%20Adv%202007.pdf> Publication Date: May 23, 2007; On pp. 483-514; Chunsun Zhang et al.

Sonia Ramirez-Garciaa, et.al.; Towards the Development of a Fully Integrated Polymeric Microfluidic Platform for Environmental Analysis; Elesvier B.V.; Apr. 12, 2008; pp. 463-467.

* cited by examiner

FLUID EJECTION DEVICE INCLUDING RECIRCULATION SYSTEM

CROSS-REFERENCE TO RELATED PATENT APPLICATIONS

The present application is a continuation application of U.S. patent application Ser. No. 16/217,008, filed Dec. 11, 2018, and which is a continuation application of U.S. patent application Ser. No. 15/432,400, filed Feb. 14, 2017, which is a continuation application of U.S. patent application Ser. No. 14/737,050 filed Jun. 11, 2015, which is a continuation application of U.S. patent application Ser. No. 13/643,646, filed Oct. 26, 2012, which is a US National Application claiming domestic benefit from PCT/US2010/035697, filed May 21, 2010, each of which is incorporated herein by reference.

BACKGROUND

Inkjet printing has become widely known and is most often implemented using thermal inkjet technology. Such technology forms characters and images on a medium, such as paper, by expelling droplets of ink in a controlled fashion so that the droplets land on the medium. The printer, itself, can be conceptualized as a mechanism for moving and placing the medium in a position such that the ink droplets can be placed on the medium, a printing cartridge which controls the flow of ink and expels droplets of ink to the medium, and appropriate hardware and software to position the medium and expel droplets so that a desired graphic is formed on the medium. A conventional print cartridge for an inkjet type printer includes an ink containment device and an ink-expelling apparatus or fluid ejection device, commonly known as a printhead, which heats and expels ink droplets in a controlled fashion.

The printhead is a laminate structure including a semiconductor or insulator base, a barrier material structure that is honeycombed with ink flow channels, and an orifice plate that is perforated with nozzles or orifices. The heating and expulsion mechanisms consist of a plurality of heater resistors, formed on the semiconductor or insulating substrate, and are associated with an ink-firing chamber and with one of the orifices in the orifice plate. Each of the heater resistors are connected to the controlling mechanism of the printer such that each of the resistors may be independently energized to quickly vaporize and to expel a droplet of ink.

During manufacture, ink with a carefully controlled concentration of dissolved air is sealed in the ink reservoir. When some types of ink reservoir are installed in a printer, the seal is broken to admit ambient air to the ink reservoir. Exposing of the ink to the ambient air causes the amount of air dissolved in the ink to increase over time. When additional air becomes dissolved in the ink stored in the reservoir, this air is released by the action of the firing mechanism in the firing chamber of the printhead. However, an excess of air accumulates as bubbles. Such bubbles can migrate from the firing chamber to other locations in the printhead where they can block the flow of ink in or to the printhead. Air bubbles that remain in the printhead can degrade the print quality, can cause a partially full print cartridge to appear empty, and can also cause ink to leak from the orifices when the printer is not printing.

Inkjet printing systems use pigment-based inks and dye-based inks. Pigment-based inks contain an ink vehicle and insoluble pigment particles often coated with a dispersant that enables the particles to remain suspended in the ink vehicle. Pigment-based inks tend to be more durable and permanent than dye-based inks. However, over long periods of storage of an inkjet pen containing pigment-based inks, gravitational effects on pigment particles and/or degradation of the dispersant can cause pigment settling or crashing, which can impede or completely block ink flow to the firing chambers and nozzles in the printhead. The result is poor performances, such as poor out-of-box performances (i.e. performance after shelf time) by the printhead and reduced image quality.

Furthermore, local evaporation of volatile components of ink, mostly water for aqueous inks and solvent for non-aqueous inks, results in pigment-ink vehicle separation (PIVS) or increased ink viscosity and viscous plug formation that prevents immediate printing. Printing systems tend to use thus massive ink spitting (ink wasting) before print job. This amount of ink sometimes exceeds multiple times the amount of ink used for image on paper.

Thus, although several suitable inkjet printheads are currently available, improvements thereto are desirable to obtain more durable and reliable printheads that will produce higher quality print images on print media surface.

DETAILED DESCRIPTION

Figure 1:
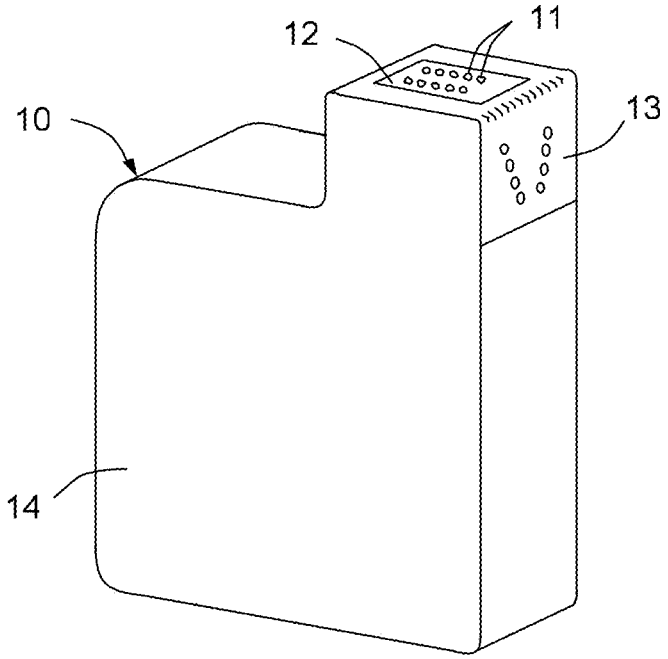
FIG. 1 is a perspective view of one embodiment of an inkjet pen.

Before particular embodiments of the present invention are disclosed and described, it is to be understood that the present disclosure is not limited to the particular process and materials disclosed herein. It is also to be understood that the terminology used herein is used for describing particular embodiments only and is not intended to be limiting, as the scope of the present invention will be defined only by the claims and equivalents thereof. In describing and claiming the present exemplary composition and method, the following terminology will be used: the singular forms "a", "an", and "the" include plural referents unless the context clearly dictates otherwise. When referring to the drawings, reference numerals denote the same elements throughout the various views.

Representative embodiments of the present disclosure include a fluid ejection device in the form of a printhead used in inkjet printing. However, it should be noted that the present disclosure is not limited to inkjet printheads and can be embodied in other fluid ejection devices used in a wide range of applications.

A system and method for re-circulating printing fluid are provided. Such system includes a fluid ejection device or printhead 12 including a recirculation system 15. In some embodiments, the fluid ejection device 12 contains at least one recirculation system that includes, at least, one drop generator 24; recirculation channels including an inlet channel 16, an outlet channel 17 and a connection channel 18 and a fluid feedhole 22 that communicates with the drop generator 24 via the inlet channel 16 and the outlet channel 17 of the recirculation channels. In some examples, the recirculation system is an asymmetrical short loop recirculation system. Such asymmetry results in pressure vector that lead to printing fluid circulation.

The present disclosure refers also to an inkjet pen containing such fluid ejection device. In some examples, the inkjet pen contains also a plurality of orifices or nozzles through which the drops of printing fluid are ejected.

In some embodiments, the fluid ejection device, containing the recirculation system as defined herein, is primarily used for inkjet imaging application. In some examples, the fluid ejection device includes a recirculation system that is a short loop recirculation system.

The inkjet pen containing the fluid ejection device or printhead of the present disclosure presents excellent printing capability as well as high resolution and high ink efficiency. Indeed, the use of the fluid ejection device or printhead, containing the recirculation system, increases ink efficiency utilization by improving nozzle health, by reducing the pigment-vehicle separation phenomenon and by managing and reducing chamber air bubbles. In addition, the use of the fluid ejection device or printhead decreases de-capping problems and potential kogation issues.

The use of the fluid ejection device significantly reduces or eliminates pigment-ink vehicle separation by ink mixing and ink local agitation in the recirculation fluidic system. The recirculation system helps to avoid the settling or crashing of pigments that often occurs in pigment-based ink compositions. Thus, in some embodiments, the inkjet pen containing the fluid ejection device according to the present disclosure presents good image quality even after prolonged idling period of inkjet pens in printer.

FIG. 1 shows an illustrative embodiment of an inkjet pen 10 having a fluid ejection device in the form of a printhead 12. The inkjet pen 10 includes a pen body 14 that contains a printing fluid supply. As used herein, the term "printing fluid" refers to any fluid used in a printing process, including but not limited to inks, pre-treatment compositions, fixers, etc. In some examples, the printing fluid is an inkjet ink. In some other examples, the printing fluid is a pigment-based ink composition. Other possible embodiments include fluid ejection devices that eject fluids other than printing fluid. The printing fluid supply can include a fluid reservoir wholly contained within the pen body 14 or, alternatively, can include a chamber inside the pen body 14 that is fluidly coupled to one or more off-axis fluid reservoirs (not shown). The printhead 12 is mounted on an outer surface of the pen body 14 in fluid communication with the printing fluid supply. The printhead 12 ejects drops of printing fluid through a plurality of nozzles 11 formed therein. Although a relatively small number of nozzles 11 are shown in FIG. 1, the printhead 12 may have two or more columns with more than one hundred nozzles per column. Appropriate electrical connectors 13 (such as a tape automated bonding "flex tape") are provided for transmitting signals to and from the printhead 12.

The fluid ejection device or printhead 12 of an inkjet printer forms part of a print cartridge or inkjet pen 10 mounted in a carriage. The carriage moves the print cartridge or inkjet pen back and forth across the paper. The inkjet pen 10 operates by causing a small volume of ink to vaporize and be ejected from a firing chamber through one of a plurality of orifices or nozzles 11 so as to print a dot of ink on a recording medium such as paper. The orifices or nozzles 11 are often arranged in one or more linear nozzle arrays. The orifices or nozzles 11 are aligned parallel to the direction in which the paper is moved through the printer and perpendicular to the direction of motion of the printhead. The properly sequenced ejection of ink from each orifice causes characters, or other images, to be printed in a swath across the paper.

Figure 2:
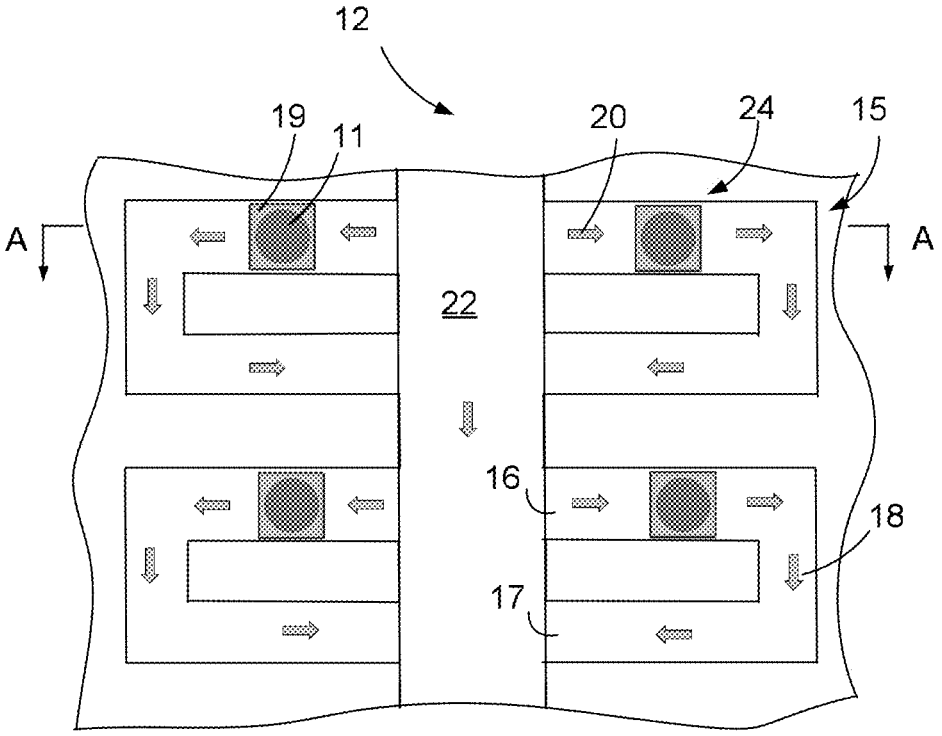
FIG. 2 is a top view of one embodiment of a fluid ejection device containing a plurality of recirculation systems.

FIG. 2 shows an illustrative embodiment of a fluid ejection device (or printhead) 12 containing a plurality of recirculation system 15 and a plurality of drop generator 24. In some examples, each recirculation system 15 contains at least a drop generator 24; each drop generator 24 includes a firing element 19 and a firing chamber 26. In some other examples, the drop generator 24 includes a nozzle 11. As illustrated herein, the fluid ejection device contains a plurality of recirculation systems 15 each including recirculation channels having an inlet channel 16, an outlet channel 17 and a connection channel 18.

In some embodiments, the fluid ejection device 12 contains a fluid feedhole or ink slot 22 that communicates with drop generator 24 via the inlet channel 16 and the outlet channel 17 of the recirculation channel. In some examples, the recirculation system 15, containing inlet channel 16, outlet channel 17 and connection channel 18, has a U-shape and forms a short loop recirculation system. In such system, the printing fluid 20 enters the recirculation system via the inlet channel 16, goes to the drop generator 24, follows the flow via the connection channel 18 and goes back to the fluid feed hole or ink slot 22 via the outlet channel 17.

Figure 3:
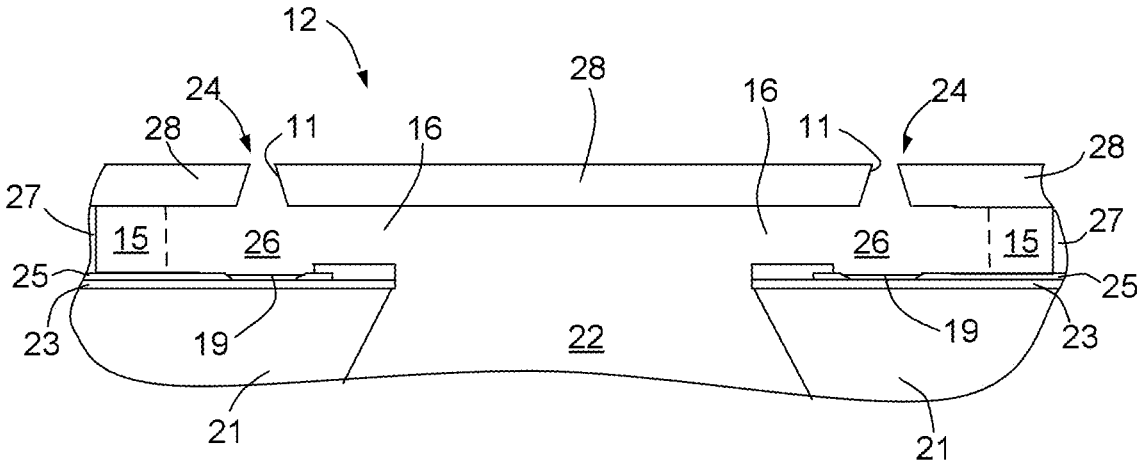
FIG. 3 is a cross-sectional side view of one embodiment of the fluid ejection device taken along line A-A of FIG. 2.

Although FIGS. 2 and 3 illustrate one possible printhead configuration, it should be noted that other configurations might be used in the practice of the present disclosure.

FIG. 3 shows an illustrative cross-sectional view of one embodiment of the fluid ejection device 12 taken along line A-A of FIG. 2. Referring to FIG. 3, the fluid ejection device or printhead 12 includes a substrate 21 having at least one fluid feed hole 22 or ink slot 22 formed therein with a plurality of drop generators 24 arranged around the fluid feed hole 22. The fluid feedhole 22 is an elongated slot in fluid communication with the printing fluid supply. Each drop generator 24 includes one of the nozzles 11, a firing chamber 26, an inlet channel 16 or an outlet channel 17 establishing fluid communication between the fluid feed hole 22 and the firing chamber 26, and a firing element 19 disposed in the firing chamber 26.

The feed channel can be either an inlet channel 16 or an outlet channel 17 depending on the direction of the printing fluid flow along the recirculation system 15. The firing elements 19 can be any device, such as a resistor or piezoelectric actuator, capable of being operated to cause drops of fluid to be ejected through the corresponding nozzle 11. In some examples, the firing element 19 is a resistor. In the illustrated examples, an oxide layer 23 is formed on a front surface of the substrate 21, and a thin film stack 25 is applied on top of the oxide layer 23. The thin film stack 25 generally includes an oxide layer, a metal layer defining the firing elements 19 and conductive traces, and a passivation layer. A chamber layer 27 that defines the recirculation system 15 is formed on top of the thin film stack 25. A top layer 28 that defines the nozzles 11 and the recirculation system 15 is formed on top of the chamber layer 27. The recirculation system 15, such as illustrated herein, represents the inlet channel 16 or the outlet channel 17 and the connection channel 18.

Each orifice or nozzle 11 constitutes the outlet of a firing chamber 26 in which is located a firing element 19. In printing operation, a droplet of printing fluid 20 is ejected from a nozzle 11 by activating the corresponding firing element 19. The firing chamber 26 is then refilled with printing fluid, which flows from the fluid feed hole 22 via the recirculation channels through the inlet channel 16. For example, to print a single dot of ink in a thermal inkjet printer, in the instance where the firing elements 19 are resistors, an electrical current from an external power supply that is passed through a selected thin film resistor. The resistor is thus energized with a pulse of electric current that heated the resistor 19. The resulting heat from the resistor 19 superheats a thin layer of the adjacent printing fluid causing vaporization. Such vaporization creates a vapor bubble in the corresponding firing chamber 26 that quickly expands and forces a droplet of printing fluid to be ejected through the corresponding nozzle 11. When the heating element cools, the vapor bubble quickly collapses, drawing more printing fluid into the firing chamber 26 in preparation for ejecting another drop from the nozzle 11.

The expanding bubble, from firing element or resistor 19, also pushes printing fluid backward in inlet channel 16 or outlet channel 17 toward the printing fluid supply. Such bubbles create thus a shock wave that results in directional pulsed flows and that create printing fluid circulation along the recirculation channels and along the recirculation system. Thus, the recirculation of the printing fluid involves air bubbles contained in the printing fluid and purges them from firing chambers 26.

In some examples, the collapsing bubble pulls the printing fluid 20 through the outlet channel 17, and allows thus a partial refilling of the firing chamber 26. Firing chamber refill is completed by capillary action. In addition, such capillary action make the printing fluid 20 moves from the fluid feedhole 22 to the next inlet channel 16 of the recirculation system and then to the drop generator 24. Thus, in some examples, the fluid ejection device according to the present disclosure does not accumulate bubbles in the firing chamber and does not present disadvantages often associated with the presence of such air bubbles.

Figure 4A:
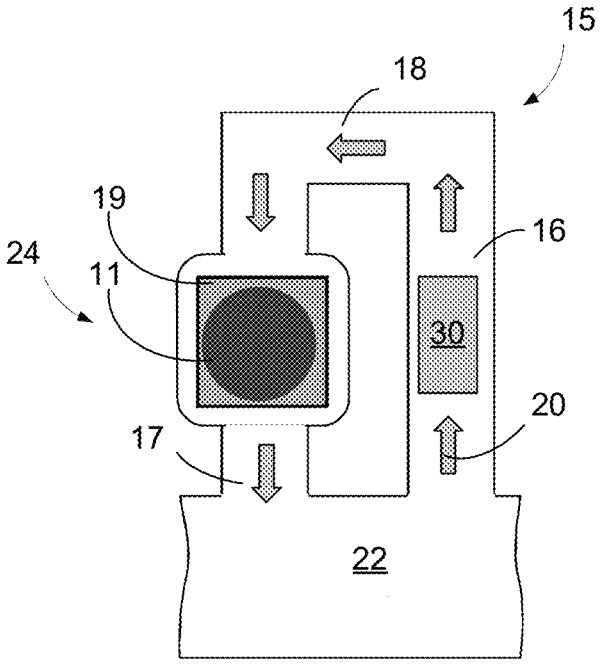
FIGS. 4A and 4B are top views of embodiments of the recirculation system present in the fluid ejection device.
Figure 4B:
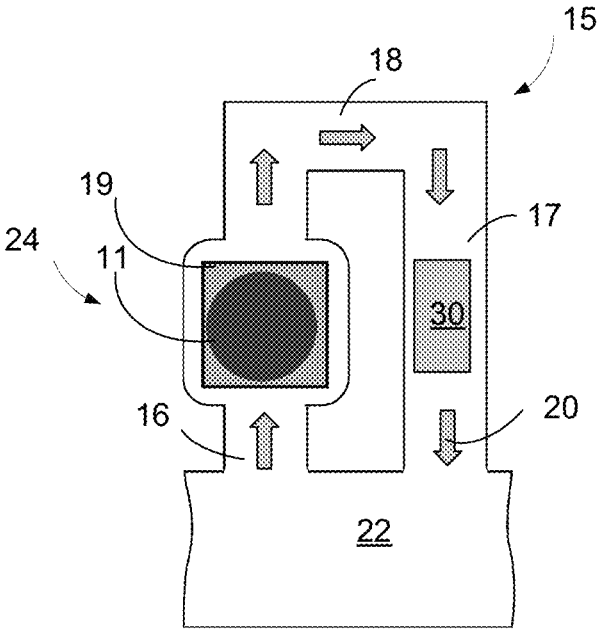

FIGS. 4A and 4B show illustrative embodiments of fluid ejection device or printhead 12 containing recirculation system 15. In such illustrated embodiment, recirculation system 15 contains one drop generator 24, including a nozzle 11 and a firing element 19, and a recirculation channel including an inlet channel 16, an outlet channel 17 and a connection channel 18. The fluid ejection device contains an fluid feedhole 22 that communicates with drop generator 24 via inlet channel 16 and outlet channel 17.

As illustrated in FIGS. 4A and 4B, fluid ejection device 12 includes one U-shaped recirculation system having a recirculation system 15 that includes inlet channel 16 and outlet channel 17 in communication with the fluid feedhole 22. As illustrated herein, recirculation system 15 forms an arch. In some examples, the U-shaped recirculation system 15 encompasses an inlet channel 16 and an outlet channel 17 that help conveying the printing fluid and that are situated parallel from each other. In some other examples, inlet channel 16 and outlet channel 17 of the recirculation system are connected with each other via a connection channel 18 in view of forming the recirculation channel or system 15.

In some examples, as illustrated in FIG. 4A, drop generator 24 is located in the inlet channel 16. This configuration means thus that printing fluid flows from inlet channel 16 through drop generator, through connection channel 18 and then go back to fluid feedhole 22 via outlet channel 17.

In some examples, as illustrated in FIG. 4B, the drop generator 24 is located in the outlet channel 17. This configuration means thus that the fluid flows from inlet channel 16, go though connection channel 18 and then go through drop generator 24 before returning to fluid feedhole 22 via outlet channel 17. In both of these situations, when the printing fluid flows through drop generator 24, a printing fluid drop can be ejected through nozzle onto printed media without influencing printing fluid direction flow.

In some embodiments, as illustrated in FIGS. 4A and 4B, the fluid ejection device 12 includes auxiliary resistor 30 located in the recirculation system 15. The auxiliary resistor 30 can be located in inlet channel 16 (such as illustrated in FIG. 4A) or in outlet channel 17 (such as illustrated in FIG. 4B). As used herein, the auxiliary resistor 30 can be compared to a "drop generator" that is not able to eject a drop, i.e. that does not have nozzle but that contains firing element 19 such as resistor or piezoelectric actuator. In other word, the auxiliary resistor 30 is able to create a bubble without ejecting a drop of ink, creating thus waves that induce a print fluid flow 20. Without being linked by any theory, it is believed that the activation of such auxiliary resistor 30 improves recirculation phenomena on the recirculation system 15 of fluid ejection device 12.

In some embodiments, auxiliary resistor 30 operates at variable and at low firing rate of firing energies between print jobs, enabling ink mixing and recirculation with low thermal load. In some examples, the print fluid flow 20, which circulates in recirculation system 15 of fluid ejection device 12, is induced by the firing element 19 of drop generator 24 or by the auxiliary resistor 30. In some examples, the firing element 19 of drop generator 24 is heated with an amount of energy that is below the turn-on energy (TOE). In some other examples, the auxiliary resistor 30 is heated with an amount of energy that is below the turn-on energy (TOE) or that is above the TOE (i.e. full energy pulse). As used herein, turn-on energy (TOE) is the amount of energy that is delivered to a printhead to cause a drop to be ejected. When firing element 19 of drop generator 24 is fired with such turn-on energy, there is no ejection of printing fluid or ink drop. However, firing element 19 of drop generator 24 is able to generate bubbles that collapse and that create opposite direction pulsed flow. Such energy and generation of bubbles create thus shock wave that generates both directional pulsed flows that allow printing fluid 20 to circulate along recirculation system 15. Thus, in some embodiments, the firing element 19 of the drop generator 24 or the auxiliary resistor 30 acts as a pump that is activated by sub-TOE energy pulse.

In some other embodiments, the recirculation system 15 of fluid ejection device 12 of the present disclosure is an asymmetrical recirculation system. Such asymmetry results in pressure vectors that make printing fluid circulates. The recirculation system 15 can have the form of a diode. As used herein, the term "diode" refers to a fluid structure designed to create preferential flow in one direction.

In some embodiments, the recirculation system 15 of fluid ejection device 12 is a thermal inkjet short-loop recirculation system that is based on micro-fluidic diode with sub-TOE operation. The recirculation system 15 can be considered as a "thermal inkjet resistor based pump" that includes asymmetrical fluidic channel and resistor operating in pre-critical pressure mode. By "pre-critical pressure mode" it is meant herein that the system operates in a sub-TOE and non-drop ejection mode.

In some examples, fluid ejection device 12 encompasses a recirculation system 15 that has the form of an asymmetrical fluidic channel with at least one drop generator 24 or one auxiliary resistor 30 that acts as a pump which is activated by sub-TOE energy pulse and that helps the circulation of printing fluid flow. Such recirculation system 15 enables thus recirculation of the fluid and improves mixing efficiency of the printing fluid.

Such as illustrated in FIG. 4A, the printing fluid 20 flows from fluid feedhole 22, through auxiliary resistor 30, through drop generator 24 and then go back to feedhole 22. Without being linked by any theory, it is believed that this flow direction results from circulation of the printing fluid flow created by bubbles and sub-TOE or full energy pulse, generated from the auxiliary resistor 30.

Such as illustrated in FIG. 4B, the printing fluid 20 flows from fluid feedhole 22, through drop generator 24, through auxiliary resistor 30 and then go back to feedhole 22. Without being linked by any theory, it is believed that this flow direction results from the firing element 19 that eject drops of printing fluid and that, in the same time, generates fraction of bubbles that creates circulation of the printing fluid flow.

Figure 5:
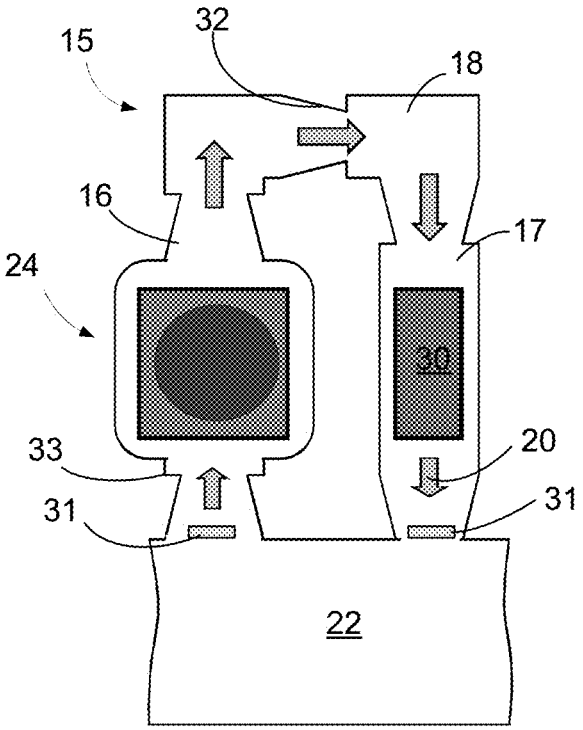
FIG. 5 is a top view of one embodiment of the recirculation system present in the fluid ejection device.

As illustrated in FIG. 5, in some examples, the fluid ejection device 12 includes a recirculation system 15 that further contains particle tolerant architectures 31. As used herein, particle tolerant architectures (PTA) refer to barrier objects that are placed in the printing fluid path to prevent particles from interrupting ink or printing fluid flow. In some examples, particle tolerant architectures 31 prevent dust and particles from blocking firing chambers 26 and/or nozzles 11. As illustrated in FIG. 5, the fluid ejection device 12 can also includes a recirculation system 15 that can contain pinch points 33 that are used to control blowback of printing fluid during drop ejection.

As illustrated in FIG. 5, in some other examples, the fluid ejection device 12 includes a recirculation system 15 that further contains non-moving part valves 32. As used herein, non-moving part valve (NMPV) refers to a non-moving object that is positioned and/or designed to regulate the flow of a fluid. It is believed that the presence of such valves 32 improves the recirculation efficiency and minimize nozzle cross talk. As "nozzle cross talk", it is meant herein that un-intended fluids flow between neighboring firing chambers.

In some embodiments, the fluid ejection device 12 includes a recirculation system that further contains non-moving part valves 32 and particle tolerant architectures 31. Particle tolerant architectures 31 can be located in the inlet channel 16 and/or in the outlet channel 17 of the recirculation system 15. The non-moving part valves 32 can be located in the connection channel 18 of the recirculation system 15. In some examples, the non-moving part valves 32 are located in connection channel 18 and in the outlet channel 17 of the recirculation system 15 of the fluid ejection device 12.

In some examples, as illustrated in FIG. 5, the recirculation flow direction corresponds to firing element activation. Without being linked by any theories, it is believed that, when the auxiliary resistor is activated, the recirculation flow can be reversed.

Figure 6A:
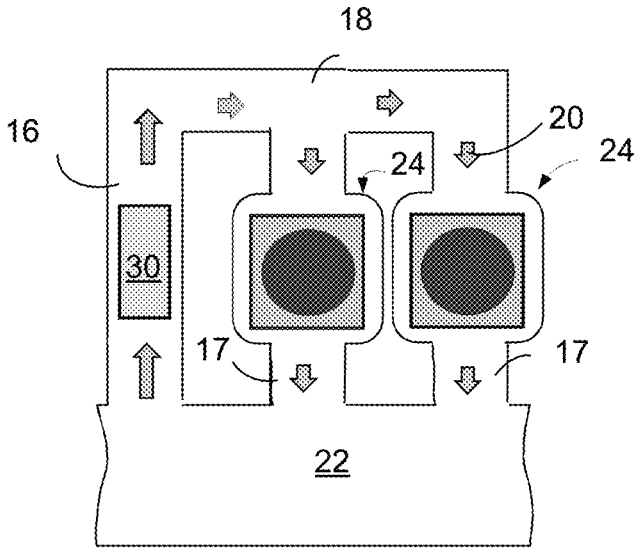
FIGS. 6A and 6B are top views of embodiments of recirculation systems including a plurality of drop firing chambers that are present in the fluid ejection device.
Figure 6B:
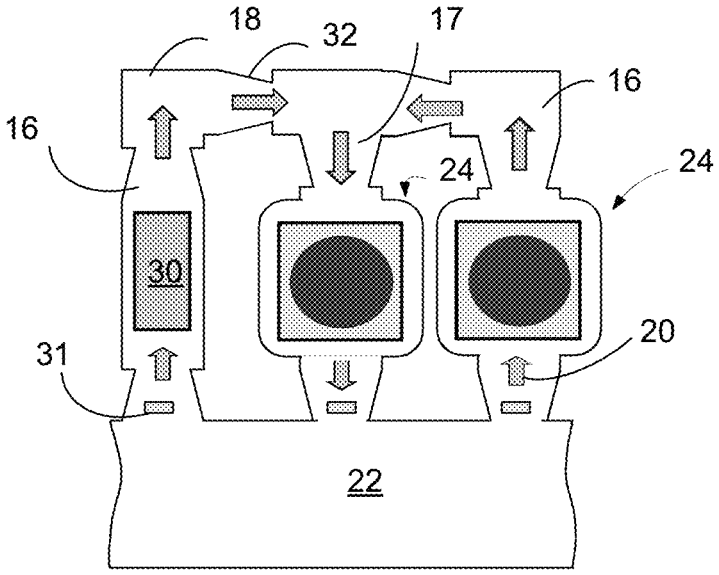

In some embodiments, as illustrated in FIGS. 6A and 6B, the recirculation system 15 of the fluid ejection device 12 includes a plurality of drop generators 24. In some examples, the recirculation system 15 is a short loop microfluidic channel and includes two or a plurality of drop generators 24 each containing a firing chamber 26 and a firing element 19.

In some examples, as illustrated in FIG. 6A, the fluid ejection device 12 includes a recirculation system 15 that encompasses two drop generators 24, one inlet channel 16, one connection channel 18 and two outlet channels 17. With such configuration, the printing fluid 20 enters the recirculation system via the inlet channel 16 and exits the recirculation system through drop generators 24 via both outlet channels 17 to go back to feedhole 22. Auxiliary resistor 30 may be present in the inlet channel 16.

In some other examples, as illustrated in FIG. 6B, the fluid ejection device 12 includes a recirculation system 15 that encompasses two drop generators 24, two inlet channels 16, one connection channel 18 and one outlet channel 17 and that contains non-moving part valves 32 and particle tolerant architectures 31. With such configuration, the printing fluid 20 enters the recirculation system via inlet channels 16 and exits the recirculation system through drop generator 24 via the outlet channel 17 to go back to the feedhole 22. In such example, auxiliary resistor 30 is present in one of the inlet channel 16 and a drop generator 24 is present in the other inlet channel 16.

In some embodiments, the fluid ejection device 12 may include one, two or a plurality of drop generators 24 connected in a daisy chain fashion for increased recirculation efficiency. Each drop generator 24 includes a firing chamber 26 and a firing element 19 disposed in its firing chamber, and corresponding open orifices (nozzles 11) to eventually eject drops during printing job. In some examples, the drop generators 24 of the fluid ejection device 12 are involved in recirculation process and are capable of jetting ink without a loss of pen resolution during printing.

Figure 7A:
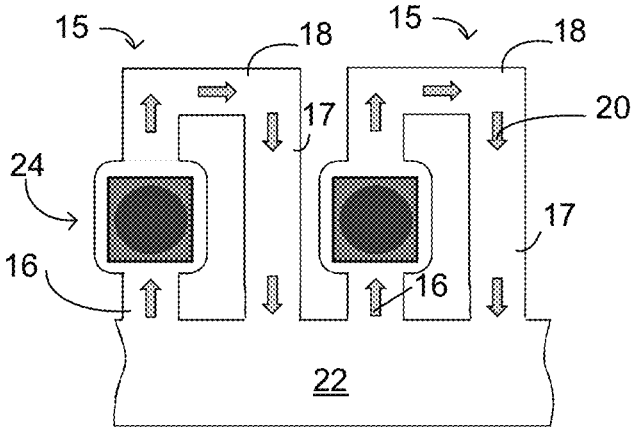
FIGS. 7A, 7B and 7C are top views of embodiments of coupled recirculation systems that are present in the fluid ejection device.
Figure 7B:
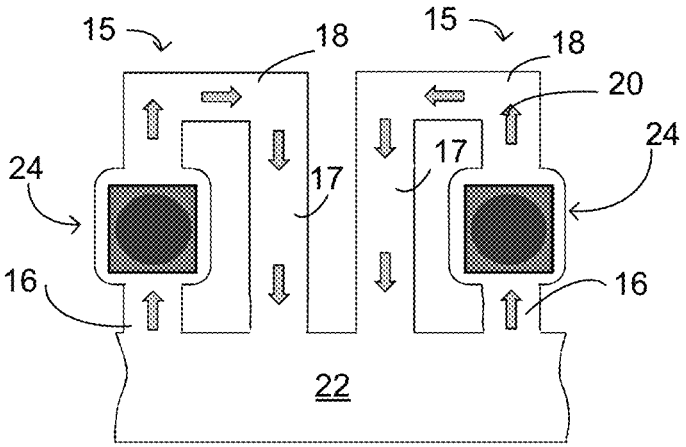
Figure 7C:
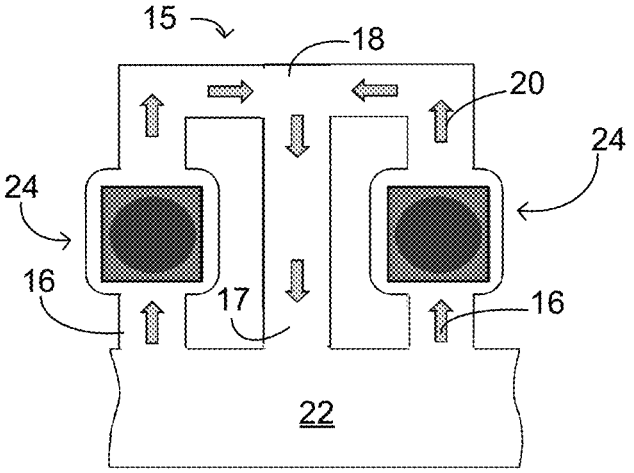

FIGS. 7A, 7B and 7C refer to examples of fluid ejection device 12 containing recirculation systems 15 that are coupled together. In some exemplary embodiments, FIGS. 7A and 7B illustrate recirculation systems 15 that are coupled together via fluid feedhole 22. In such examples, each recirculation system 15 includes a drop generator 24 that is located in the inlet channel 16. With such configuration, the printing fluid 20 flows from inlet channel 16 through the drop generator, through connection channel 18 and then go back to feedhole 22 via outlet channel 17.

In some other exemplary embodiments, such as illustrated in FIG. 7A, the printing fluid flow 20 goes back to the slot 22 and to the next drop generator 24 via the next inlet channel 16 which is located following the outlet channel 17. As illustrated in FIG. 7A, the recirculation system induces a symmetrical flow. In some examples, such as illustrated in FIG. 7B, the printing fluid flow 20 goes back to the feedhole 22 and to next drop generator 24 via the next inlet channel 16 which is located after a second outlet channel 17. As illustrated in FIGS. 7A and 7B, the recirculation systems 15 enable printing fluid recirculation and printing fluid mixing with irreversible direction of the recirculation flow.

FIG. 7C illustrates examples of two recirculation systems 15 that are coupled together via feedhole 22 and via outlet channel 17. In this example, the recirculation system 15 includes two drop generators 24 that are located in inlet channels 16. With such configuration, the printing fluid 20 flows from both inlet channels 16 through drop generators, then goes back to the feedhole 22 through connection channel 18 and via the coupled outlet channel 17. As illustrated herein, recirculation systems 15 enable printing fluid recirculation and printing fluid mixing with reversible direction of the recirculation flow. The recirculation system 15, as illustrated in FIG. 7C, has an asymmetrical flow.

Within such examples, the recirculation system 15 contains drop generators that include a firing elements 19 that generate bubbles with an amount of energy that is below the turn-on energy (TOE). Every time the ink flow through drop generators 24, ink drop can be ejected through the nozzle onto the printed media without influencing ink direction flow.

Figure 8A:
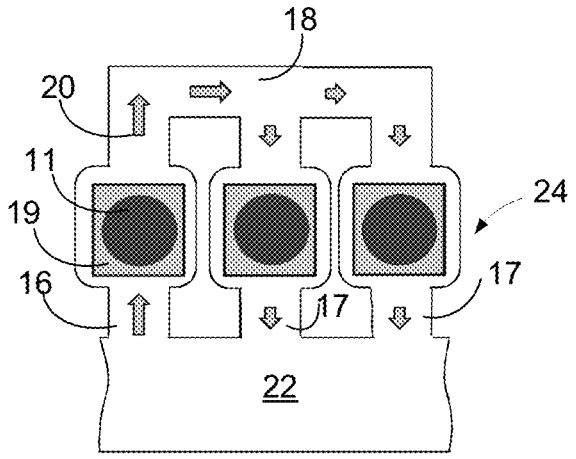
FIGS. 8A, 8B and 8C are top views of embodiments of coupled recirculation systems that contain a plurality of drop firing chambers that are present in the fluid ejection device.
Figure 8B:
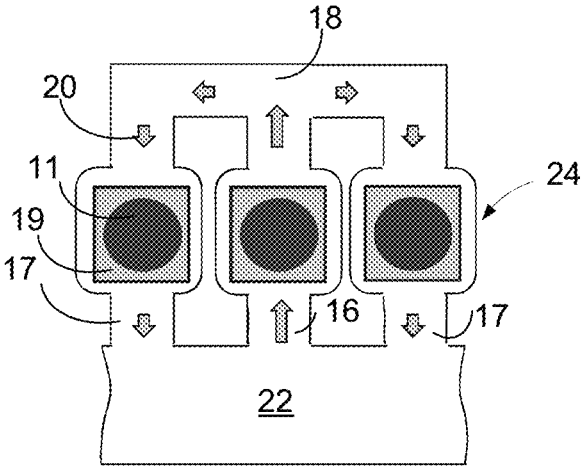
Figure 8C:
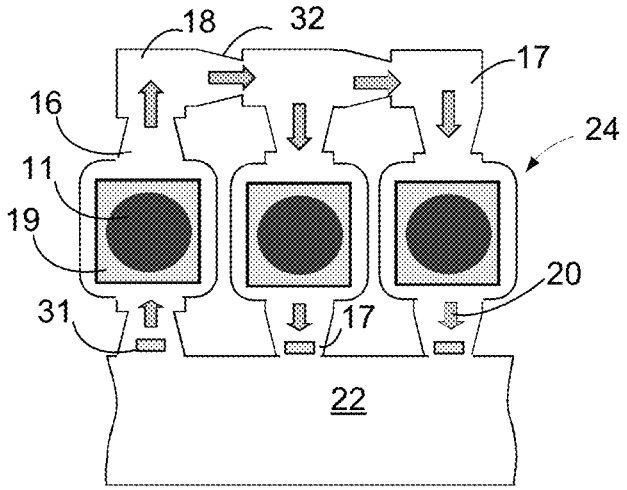

FIGS. 8A, 8B and 8C represent exemplary embodiments of fluid ejection devices 12 containing recirculation systems 15 that are coupled together and that contain a plurality of drop generators 24. In such examples, each inlet channel 16 or outlet channel 17 includes a drop generator 24. Each drop generator 24 contains a nozzle 11, a firing chamber 26 and a firing element 19 disposed in firing chamber 26. With such configuration, printing fluid 20 flows from inlet channels 16 through drop generators 24, through connection channel 18 and then go back to feedhole 22 via outlet channels 17 each containing drop generator 24.

In these examples, when the recirculation systems 15 contains several drop generators, at least one drop generator includes a firing element 19 that generates bubbles with an amount of energy that is below the turn-on energy (TOE).

In some examples, as illustrated in FIG. 8A, the recirculation system 15 induces an asymmetric flow. In some other examples, when central firing element 19 is activated, as illustrated in FIG. 8B, the recirculation system 15 induces a symmetrical flow. Within such configurations, the recirculation system 15 enables plurality of firing and recirculation sequences and enables reversible and multidirectional recirculation flows. In some other examples, to achieve non zero recirculation net flow, a recirculation system is asymmetrical with reference to firing element or auxiliary resistor.

In some embodiments, as illustrated in FIG. 8C, the recirculation system 15 contains several drop generators and includes non-moving part valves 32 and particle tolerant architectures 31. In some examples, all channels 16, 17 and 18 of the recirculation system include non-moving part valves 32 for coupling efficiency control. Indeed, it is believed that such valves may improve recirculation efficiency and minimize nozzle cross talk. Furthermore, channels can contain particle tolerant architectures 31 located before drop generators 24. In some examples, drop generators 24 have open orifices, such as nozzles 11, and can either be used to recirculate ink in firing chamber at sub-TOE firing pulses or can be used to eject drops of ink.

In some other examples, all firing chambers 26, having a firing element 19 present in the fluid ejection device 12, can operates with variable low firing rate and with sub-TOE firing energies between print jobs. With such low firing energy, the recirculation system 15 enables ink mixing and recirculation with low thermal load.

In some embodiment, the fluid ejection device contains a recirculation system that include a plurality of drop generators 24, at least an auxiliary resistor, non-moving part valves 32 and particle tolerant architecture 31. Therefore, fluid ejection device or printhead 12 containing recirculation systems 15 enables a plurality of firing and recirculation sequences. Such recirculation system 15 enables thus reversible and multidirectional recirculation flows. In some examples, the activation sequences of re-circulating firing chamber are coordinated in view of obtaining optimal recirculation and following mixing of the printing fluid.

In some embodiments, the fluid ejection device is designed to enable directional cross talk between drop generator and firing chamber sufficient to support recirculation net flow and limited coupling to avoid drop ejection in neighboring chambers. Any kind of NMPV may be used to optimize cross coupling of the firing chambers. Many types of fluid valves could be designed to reduce the amount of fluid that flows between chambers in an undesirable way (cross talk reduction).

The fluid ejection device according to the present disclosure can be used in any type of inkjet pen, or can be used indifferently in edge line technology or in wide page array technology.

An exemplary method of inducing printing fluid or ink flow, in the recirculation system 15 of fluid ejection device 12 of the present disclosure, includes applying a sub-TOE or full energy pulse to auxiliary resistor 30 and/or applying a sub-TOE energy pulse to firing element 19 of the drop generator 24. Within such method, the printing fluid 20 circulates along recirculation channels of the recirculation system 15. In addition, recirculation phenomenon continues working at drop firing energies during printing job and helps to refresh ink, manage nano-air (air bubbles in firing chamber) and purge them from firing chambers.

In some examples, a method of using the fluid ejection device 12 includes dormant period followed by purging and mixing period wherein the printing fluid is purged and mixed. The purging and mixing periods are induced by application of high firing rate at a sub-TOE or full energy pulse to auxiliary resistor 30 just before printing job and/or by application of a sub-TOE energy pulse to firing element 19 of the drop generator 24 just before printing job.

In some examples, a method of jetting printing fluid drops, from the fluid ejection device 12 such as described herein, includes: inducing a printing fluid flow in the recirculation system 15 by applying a sub-TOE or a full energy pulse to auxiliary resistor 30 and/or applying a sub-TOE energy pulse to firing element 19 of the drop generator 24; and applying an energy sufficient to able printing fluid to drop by the orifice 11 of the drop generator 24.

In some other examples, a method of jetting printing fluid drops, from the fluid ejection device 12 such as described herein, includes inducing a printing fluid flow in the recirculation system 15 by applying an energy sufficient to able printing fluid to drop by the orifice 11 of the drop generator 24. In some embodiments, the printing fluid is an ink composition. In some other embodiments, the printing fluid is an inkjet ink composition.

The preceding description has been presented only to illustrate and describe exemplary embodiments of the present disclosure. Although certain example methods, apparatus and articles of manufacture have been described herein, the scope of coverage of this patent is not limited thereto. On the contrary, this patent covers all methods, apparatus and articles of manufacture fairly falling within the scope of the claims either literally or under the doctrine of equivalents.

The invention claimed is:

1. A fluid ejection pen comprising:

electrical connectors to transmit and receive signals indicative of pressure vectors for printing fluid to flow through a plurality of recirculation channels in fluid connection with a fluid feedhole slot; and responsive to reception of signals indicative of pressure vectors, causing fluid to flow through the plurality of recirculation channels based on the pressure vectors, wherein recirculation of fluid is distinct from fluid flow based on fluid ejection.

2. The fluid ejection pen of claim 1, wherein the pen is arranged within a printing system.

3. The fluid ejection pen of claim 2, wherein the printing system is configured to enable image formation on roll-based media.

4. The fluid ejection pen of claim 1, wherein the fluid feedhole slot is arranged to feed fluid into an inlet channel of the plurality of recirculation channels.

5. The fluid ejection pen of claim 4, wherein the fluid feedhole slot is arranged to receive fluid from an outlet channel of the plurality of recirculation channels.

6. The fluid ejection pen of claim 1, wherein the pressure vectors are asymmetric.

7. The fluid ejection pen of claim 6, wherein the recirculation of fluid is based on the asymmetric pressure vectors.

8. The fluid ejection pen of claim 6, further comprising drop generators arranged within the plurality of recirculation channels.

9. The fluid ejection pen of claim 8, wherein the drop generators are arranged within the plurality of recirculation channels such that an inlet channel of the plurality of recirculation channels is a different length than an outlet channel of the plurality of recirculation channels.

10. The fluid ejection pen of claim 9, wherein the inlet channel is longer than the outlet channel.

11. The fluid ejection pen of claim 8, wherein the signals indicative of pressure vectors comprise signals to cause sub-TOE non-drop ejection activation of the drop generators.

12. The fluid ejection pen of claim 1 further comprising a fluid ejection device in which the plurality of recirculation channels and the fluid feedhole slot are formed.

13. The fluid ejection pen of claim 12, wherein the plurality of recirculation channels are formed in a chamber layer of the fluid ejection device, the fluid feedhole slot is formed in a substrate layer beneath the chamber layer, and wherein the fluid feedhole slot and the plurality of recirculation channels are arranged such that fluid is to flow from the fluid feedhole slot and into the chamber layer and then the plurality of recirculation channels.

14. The fluid ejection pen of claim 13, wherein the fluid feedhole slot and the plurality of recirculation channels are further arranged such that the fluid is to flow back into the fluid feedhole slot from the plurality of recirculation channels.

15. A fluid ejection device comprising:

a substrate in which a plurality of fluid feedhole slots is formed;

a chamber layer in which a plurality of recirculation channels is formed, the plurality of recirculation channels in fluid communication with the plurality of fluid feedhole slots, wherein the plurality of recirculation channels comprise:

an inlet channel to receive printing fluid from one of the plurality of fluid feedhole slots;

an outlet channel; and a drop ejector arranged within the plurality of recirculation channels between the inlet channel and the outlet channel and beneath a nozzle; and wherein the plurality of fluid feedhole slots and the plurality of recirculation channels are arranged such that responsive to signals indicative of pressure vectors, printing fluid is to flow through the plurality of recirculation channels in a non-drop ejection mode.

16. The fluid ejection device of claim 15, wherein the outlet channel is arranged to transmit printing fluid to the one of the plurality of fluid feedhole slots.

17. The fluid ejection device of claim 15, wherein the inlet channel is a different length from the outlet channel.

18. The fluid ejection device of claim 15, wherein the plurality of recirculation channels corresponds to short loop recirculation channels.

19. A fluid ejection system comprising:

a fluid ejection pen comprising a fluid ejection device comprising:

a plurality of fluid feedhole slots in fluid communication with a plurality of recirculation channels, the plurality of recirculation channels corresponding to short loop recirculation channels;

the fluid ejection pen arranged to form images on media received from a media roll feed mechanism of a media handling system; and electrical connectors via which may be transmitted signals indicative of pressure vectors to cause printing fluid to recirculate through the plurality of recirculation channels.

20. The fluid ejection system of claim 19, wherein the short loop recirculation channels correspond to asymmetric recirculation channels.

* * * * *